US006280138B1

(12) United States Patent
Inagi et al.

(10) Patent No.: US 6,280,138 B1
(45) Date of Patent: Aug. 28, 2001

(54) VERTICAL AXIS PUMP

(75) Inventors: Kiyoshi Inagi, Numazu; Makoto Yoshino; Hiroshi Satoh, both of Mishima, all of (JP)

(73) Assignees: Director-General Chubu Regional Construction Bureau, Minstry of Construction, Aichi; Association for Pump System Engineering; DMW Corporation, both of Tokyo, all of (JP)

( * ) Notice: Subject to any disclaimer, the term of this patent is extended or adjusted under 35 U.S.C. 154(b) by 0 days.

(21) Appl. No.: 09/456,535

(22) Filed: Dec. 8, 1999

(51) Int. Cl.[7] ..... F01D 15/12

(52) U.S. Cl. ..... 415/122.1; 415/213.1; 417/423.6

(58) Field of Search ..... 415/122.1, 111, 415/112, 175, 213.1; 184/13.1, 11.1; 417/423.6

(56) References Cited

U.S. PATENT DOCUMENTS 4,145,008 * 3/1979 Wolford ..... 241/46.17

OTHER PUBLICATIONS

Inagi Kiryo et al., Jul. 21, 1999, Abstract for "Vertical Axis Pump," Publication No. 11193799.

* cited by examiner

*Primary Examiner*—F. Daniel Lopez
*Assistant Examiner*—James M McAleenan

(57) ABSTRACT

Since a reduction gearbox (50) is mounted onto the outer wall of the discharge elbow (30), the installation height of a vertical axis pump is reduced. A pump shaft (34) comes out the outer wall of the discharge elbow (30) and passes through a separate wall (36) provided above the outer wall of the discharge elbow (30). An air space (40) is formed between the separate wall (36) and the outer wall of the discharge elbow (30). The air space (40) is open through and through to the atmosphere. A casing (76) for the reduction gearbox (50) is formed including the separate wall (36) and the outer wall of the discharge elbow (30). The reduction gearbox (50) is mounted onto the discharge elbow (30) in a one-piece construction. An output stage gear (54) of a gear train of the reduction gearbox (50) is mounted onto the pump shaft (34) comes out through the outer wall of the discharge elbow (30). An input shaft (52) of the reduction gearbox (50) comes out in the horizontal direction and is connected to a driver (86). The driver (86) and the discharge elbow (30) are installed onto the same floor level.

9 Claims, 5 Drawing Sheets

VERTICAL AXIS PUMP

TECHNICAL FIELD

The present invention relates to a vertical axis pump for achieving the reduction in height of installation.

BACKGROUND OF THE INVENTION

FIG. 7 shows the structural drawing of the pump station wherein a conventional vertical axis pump is installed. The discharge elbow 12 is mounted onto the 1st floor level 10, and column pipe 16, impeller casing 18 as well as the suction bell 20 are suspended vertically as a single body from the discharge elbow 12 into the suction water tank 14, provided below the 1st floor level 10. The reduction gearbox 24, and the driver 26 coupled to it are mounted onto the 2nd floor level 22 provided above the 1st floor level 10, and the pump shaft 28 coming out of the outer wall of the discharge elbow 12 in the vertical direction is coupled by use of a suitable coupling to the output shaft of the reduction gearbox 24. Based on drive from the driver 26, the corresponding rotational speed(RPM) being reduced by the reduction gearbox 24, the pump shaft 28 is driven by this reduced rotational speed, resulting in water being pumped up by the vertical axis pump.

Regarding the installation construction of conventional vertical axis pump, a pump room of two floor construction is required wherein the discharge elbow is mounted onto the 1st floor level 10, and the reduction gearbox 24, as well as the driver 26 are mounted onto the 2nd floor level 22 provided above the 1st floor level 10. Hence, the construction cost of such a pump room was high. In addition, as the installation height of the vertical axis pump is very high, a crane of high lift was necessary for assembly work, which in itself made assembly work very troublesome. Furthermore, optional equipment such as cooling arrangement for cooling of lubricating oil of reduction gearbox 24 was also required.

DISCLOSURE OF THE INVENTION

It is the object of the present invention to supply a vertical axis pump of low installation height, and thereby eliminate all the problem areas faced for installation of above-mentioned conventional vertical axis pump.

In order to achieve the above-mentioned object, a reduction gearbox is mounted onto the outer wall of the discharge elbow, and the pump shaft coming out through the outer wall of said discharge elbow is coupled to the said reduction gearbox. Further, the said reduction gearbox is mounted onto the outer wall of the said discharge elbow in a one-piece construction.

According to a further feature of the invention, the input shaft of the said reduction gearbox is made to come out in the horizontal direction, the driver is then coupled to it, and this driver may be installed onto the same floor level as that of the said discharge elbow.

According to a further feature of the invention, the said pump shaft penetrated out through the separate wall provided above the outer wall of said discharge elbow, forming an air space between the said separate wall and the outer wall of the said discharge elbow, and also forming a casing for the said reduction gearbox including the said separate wall. The air space is accessible from the surrounding on its either opposite side.

According to a further feature of the invention, including the outer wall of the said discharge elbow, a casing for said reduction gearbox is formed such that the lubricating oil of said reduction gearbox can flow down along the outer wall of said discharge elbow and collect within this casing.

According to another constructional aspect of the invention, air passages with both ends open to the atmosphere and passing through within the casing are provided, a fan is mounted onto the input shaft of said reduction gearbox, and the air draft created by this fan causes the air to flow through these air passages from one open end to the other open end.

According to another constructional aspect of the invention, the output stage gear of the gear train of said reduction gearbox may be mounted onto the pump shaft that comes out through the outer wall of the said discharge elbow.

According to a further preferred feature of the invention, wherein the output stage gear of the gear train of said reduction gearbox is mounted on to a hollow shaft is then inserted into the pump shaft coming out through the outer wall of the said discharge elbow and fixed.

Furthermore, it is also possible such that the pump shaft penetrates out through the separate wall provided above the outer wall of said discharge elbow, and the casing of said reduction gearbox is formed including this separate wall , and also forming a clearance gap co-axial with said pump shaft between the lower end of the hollow shaft and said pump shaft, and fixing as a tight seal , this lower end part to the said separate wall by free insertion of a hollow body co-axial to said pump shaft into this clearance gap.

BEST MODE FOR CARRYING OUT THE INVENTION

Referring now to accompanying drawings, the present invention will be described in detail.

Figure 1:
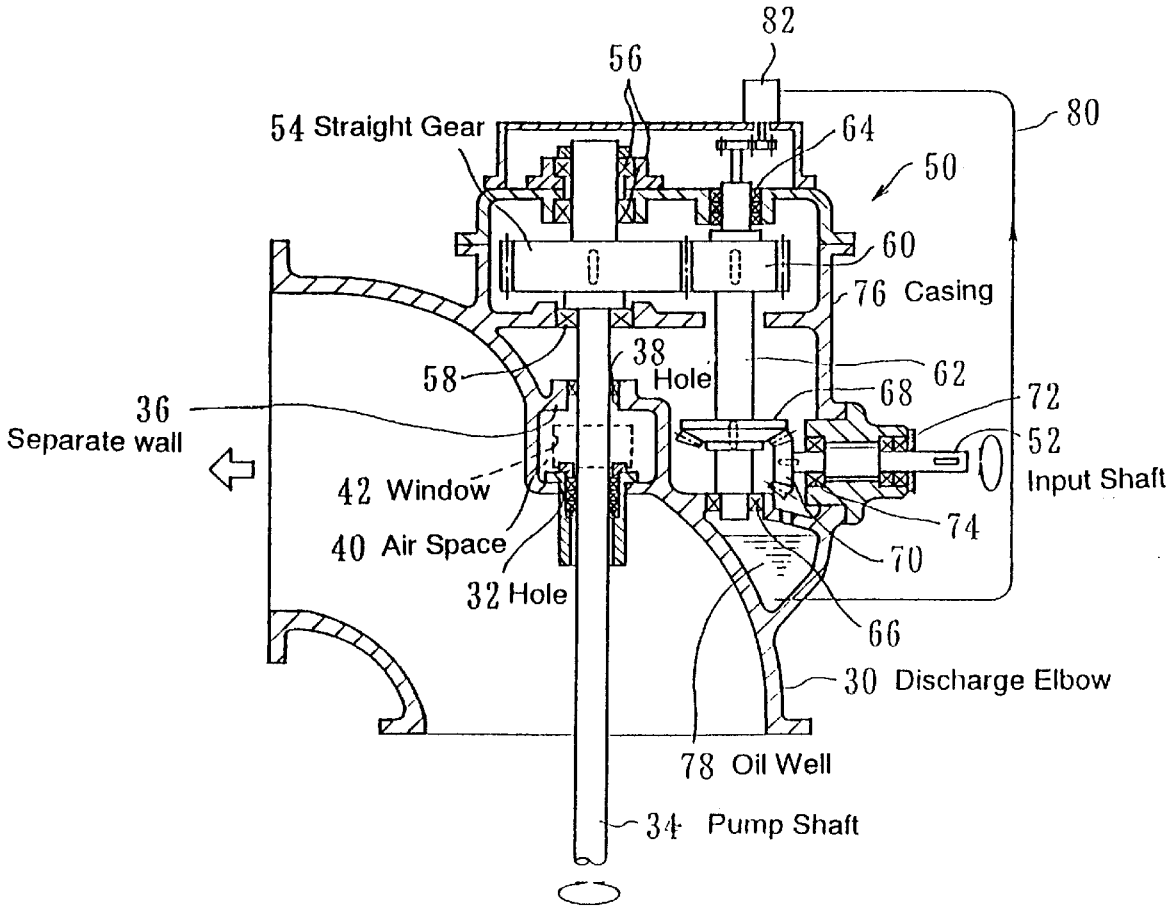
FIG. 1 illustrates the cross-sectional view of the discharge elbow of a vertical axis pump according to the invention.
Figure 2:
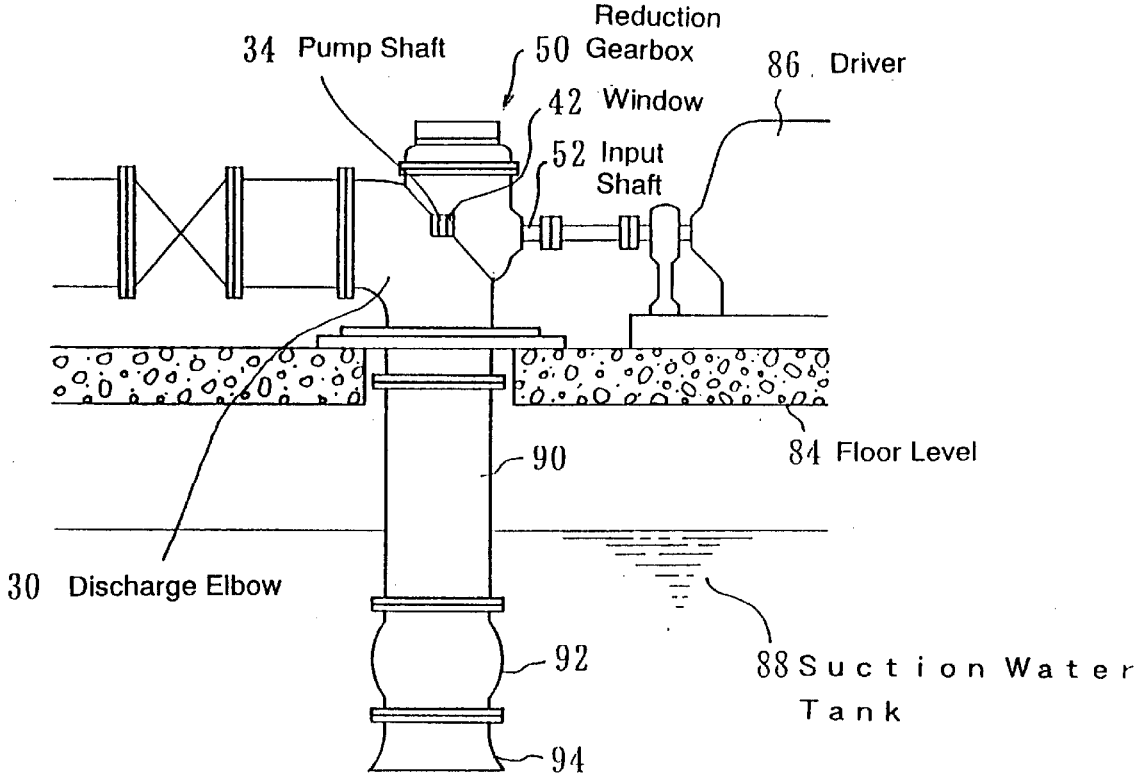
FIG. 2 is the installation construction diagram of the vertical axis pump of the invention as illustrated in FIG. 1.

In FIG. 1 and FIG. 2, a through hole 32 is bored on the upper side of the outer wall of the discharge elbow 30, and the pump shaft 34 passes through it with a water tight sealing being provided by means of gland packing. Furthermore, a through hole 38 is also bored in the separate wall 36 provided above the outer wall of the discharge elbow 30, through which also the pump shaft 34 passes, where a tight sealing is provided by means of an oil seal. An air space 40 is now formed between this separate wall 36 and the outer wall of discharge elbow 30. Window 42 is provided on either side of this air space 40 to be accessible from the outside.

The reduction gearbox 50 is attached onto the outer wall of the discharge elbow 30 in a one-piece construction, and is then coupled to the pump shaft 34, and its input shaft 52 is made to come out in the horizontal plane in a direction opposite to the direction of discharge.

The configuration of the reduction gearbox 50 is as explained hereafter. For the purpose of speed reduction, straight gear 54 that is the output stage gear of the gear train is mounted onto pump shaft 34 coming out of the discharge elbow 30, the pump shaft 34 is suitably supported by means of bearing 56, 56 and 58. Straight gear 60 meshing with straight gear 54 is mounted onto the intermediate shaft 62, which is also suitably supported parallel to the pump shaft 34 by means of bearing 64, 66. Bevel gear 68 is fixed to this intermediate shaft 62. And the pinion gear 70 meshing with this bevel gear 68 is mounted onto the input shaft 52, suitably supported by bearing 72, 74 and having its axis of rotation in the horizontal plane perpendicular to the pump shaft and coming out in a direction opposite to the direction of discharge from the discharge elbow.

Furthermore, casing 76 of reduction gearbox 50 is formed in a single-body construction with the outer wall discharge elbow 30 by including the separate wall 36. The bearings 56, 56, 58, 64, 66, 72, 74 are obviously mounted suitably within this casing 76. The casing 76 may be cast as a part of the discharge elbow in a one-piece construction or it may be separately fabricated from steel plates and then attached to the outer wall of discharge elbow 30 by suitable methods. Above this, the casing 76 can also be shaped with suitable flanged connections to facilitate ease in assembly of gear train of reduction gearbox 50. Further still, one end of main oil pipe 80 is opened into the oil well 78 inside the casing 76. The other end of this main oil pipe 80 is connected to the main oil pump 82 provided on the upper part of casing 76, which is coupled to and driven by means of intermediate shaft 62. Here, based on drive from oil pump 82, the lubricating oil from the oil well 78 can be suction lifted and thereby supply oil to the gear train from above, and on flowing downstream into the oil well 78, be once again suction lifted and thereby circulated continuously.

As shown in FIG. 2, onto the floor level 84 on which the discharge elbow 30 is installed, the driver 86 to which the input shaft 52 of reduction gearbox 50 is suitably connected by use of coupling, is also installed. Here, as the input shaft 52 is made to come out in the horizontal plane in a direction opposite to the discharge direction of the discharge elbow 30, the installation height of the vertical axis pump reduces, a high lift crane and such is not required, and assembly work can be carried out with ease. Furthermore, the conventional two- floor pump room is done away with, and a single floor pump room is sufficient, which in itself reduces the construction cost of the pump room. Further still the lubricating oil within the casing 76 flows downstream along the outer wall of the discharge elbow 30, and is collected in the oil well 78, hence as such is always in direct contact with the outer wall of the discharge elbow 30, and thus effective and efficient cooling of the lubricating oil takes place by the fluid flowing through the in side of the discharge elbow 30. Hence, requirement of a cooling arrangement for the lubricating oil as optional equipment is eliminated. Furthermore, depending upon the pressure of the working fluid flowing through the inside of the discharge elbow 30, even if leakage should occur from the hole 32 in spite of use of gland packing seal, it is discharged to the outside through the window 42 provided on either side. Hence, penetration into the casing through the hole 38 in the separate wall 36 above is not there, subsequently increasing the mechanical reliability of the reduction gearbox 50. Still further, as the output stage straight gear 54 of the gear train is mounted onto the pump shaft 34, hence compared to the conventional arrangement wherein the pump shaft 34 is connected to the output shaft of reduction gearbox 50 by use of coupling, the assembly becomes simpler, and assembly work is also more convenient as there are fewer individual parts.

Figure 3:
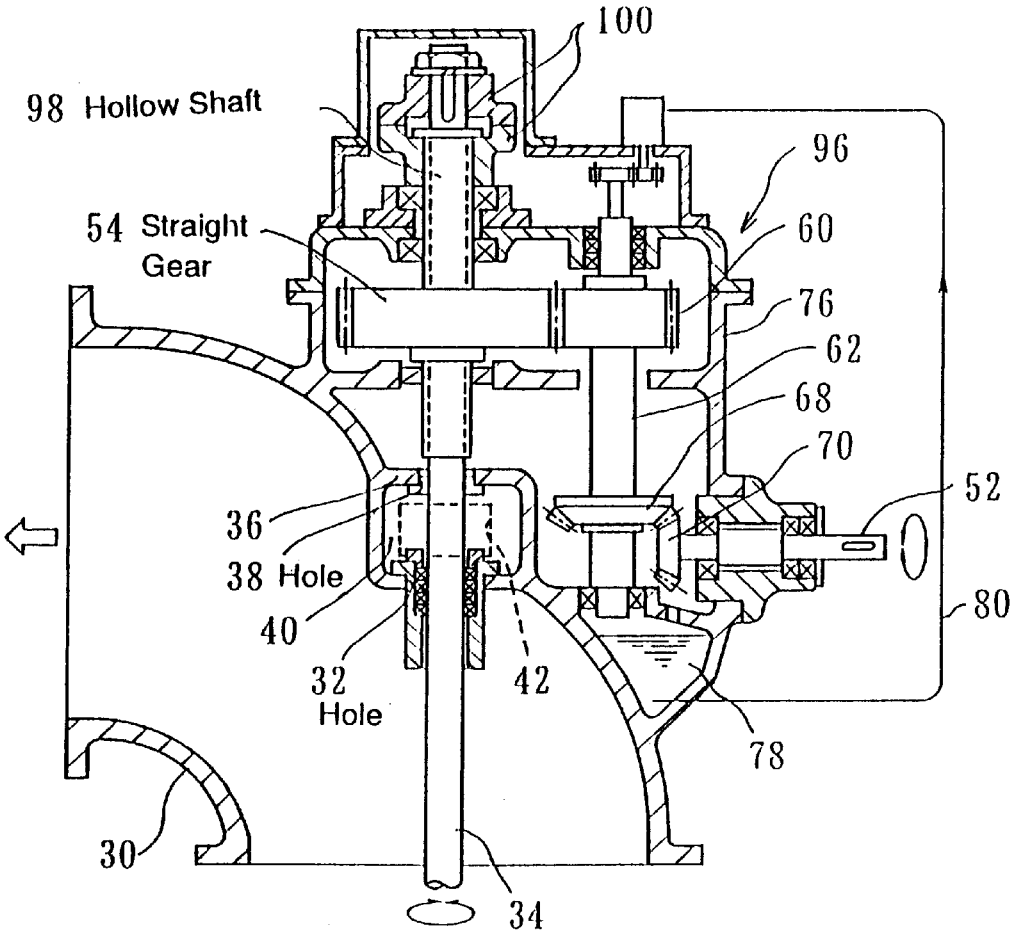
FIG. 3 is a cross-sectional view of the discharge elbow as per another practical example of the vertical axis pump according to the invention.
Figure 4:
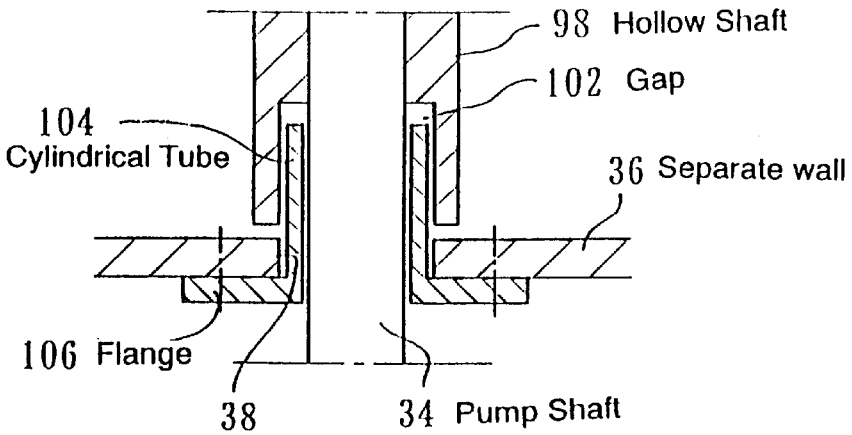
FIG. 4 is the cross-sectional view illustrating the constructional features of the lower end of hollow shaft shown in FIG. 3.

A further practical embodiment of the vertical pump according to the invention is explained hereafter with reference to FIG. 3 and FIG. 4.

Reduction Gearbox 96 illustrated in FIG. 3 differs from reduction gearbox 50 illustrated in FIG. 1 in the following features. Firstly, straight gear 54 that is the output stage gear of the gear train is mounted onto hollow shaft 98. This hollow shaft 98 is then inserted onto the pump shaft 34, and then coupled to it by means of coupling 100, 100. Further, as shown in FIG. 4 the lower end of the hollow shaft 98 which meets the separate wall 36 has an increased inner diameter, resulting in the format ion of a co-axial gap 102 between the hollow shaft 98 and pump shaft 34. Into this gap 102 is freely inserted a cylindrical tube 104 on whose lower end a flange plate 106 is provided which is fixed to the separate wall 36, resulting in the cylindrical tube 106 becoming a tight seal for the separate wall 36.

Regarding the constructional feature , reduction gearbox 96 is initially attached onto the discharge elbow 30, this assembly is then lowered down from above the pump shaft 34, and hollow shaft is consequently inserted onto the pump shaft 34 and coupled to it, which completes the assembly. The assembly work of the reduction gearbox 96 and the discharge elbow 30 can be carried out in the manufacturing plant itself, thereby reducing the work to be done at the pump installation site, and consequently resulting in increased working efficiency. Further, lubricating oil dropping down below the hollow shaft 98, cannot pass through the hole 38 in separate wall 36 because of the cylindrical tube 104 forming a kind of sealing, and hence cannot leak out from the casing 76.

Figure 5:
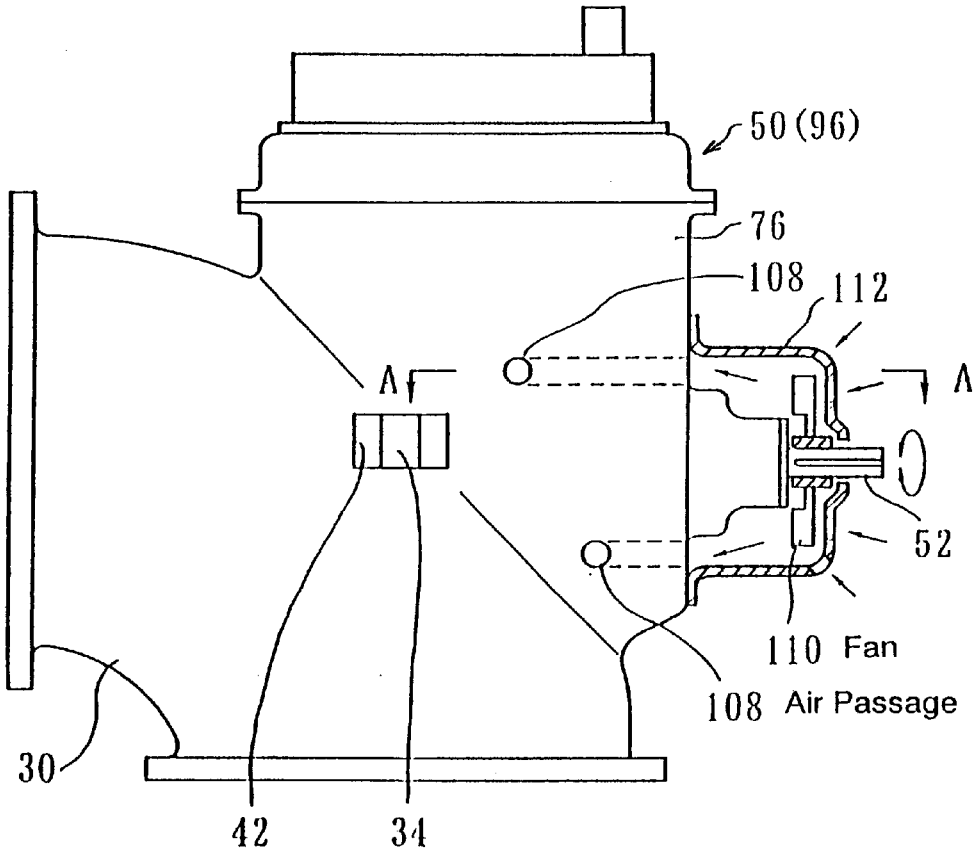
FIG. 5 is a drawing that explains the cooling arrangement for the lubricating oil of the reduction gearbox in a different example of the vertical axis pump of the invention.
Figure 6:
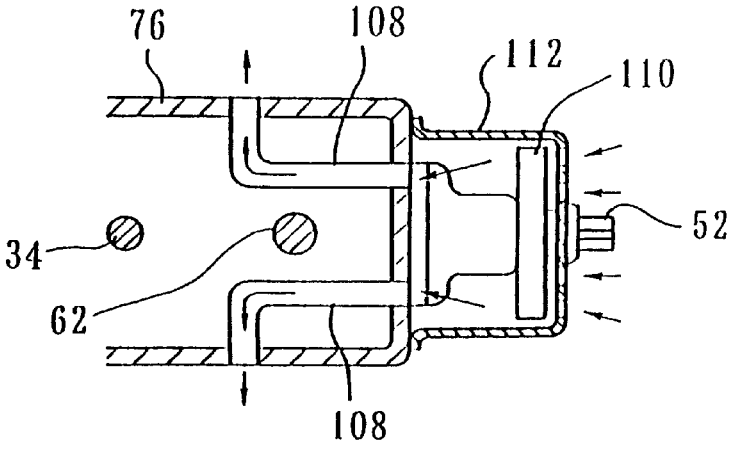
FIG. 6 illustrates the cross-sectional view A—A as indicated in FIG. 5.
Figure 7:
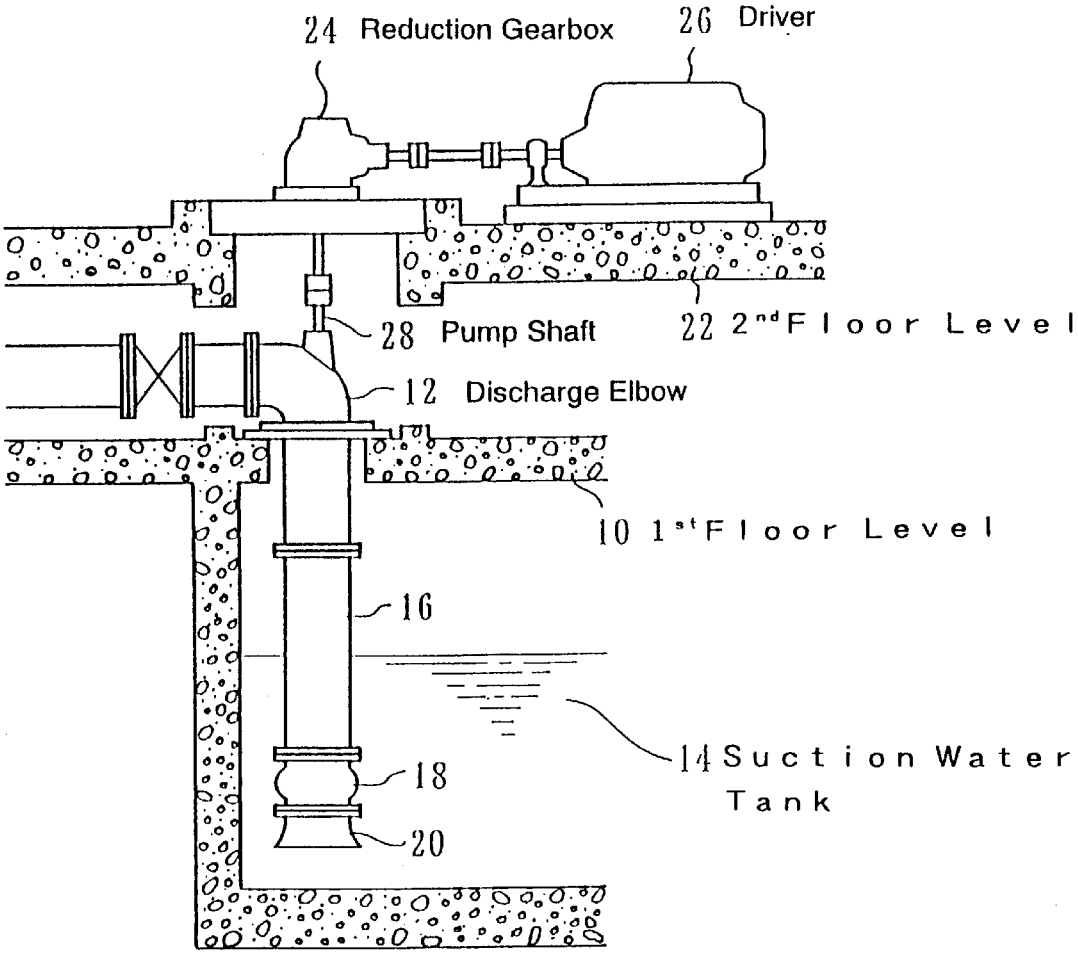
FIG. 7 is the outline drawing of a pump room installed with a conventional vertical axis pump.

A still further application embodiment indicating a different aspect of the vertical axis pump according to the invention is explained hereafter with reference to FIG. 5 and FIG. 6 attached thereto.

As illustrated in FIG. 5 and FIG. 6, air passages 108, 108 having both ends open to the atmosphere and passing through within the inside of the casing 76 of reduction gearbox 50 (96) are provided. Obviously, the air passages are arranged such as to not cause any interference to the internal gear train. A fan 110 in mounted onto the input shaft 52. Surrounding it ,as air chamber 112 is provided. Holes are provided to this air chamber 112 to enable suitable suction of air. The air sucked in on account of the fan 110 enters into the air passages 108, 108 from end and flows through the inside of these air passages towards the other end.

The above embodiment mentions that the fan 110 is mounted onto the input shaft 52, however not limited to this, it is also possible that the fan may be coupled to the input shaft 52 and consequently driven.

Relating to the above constructional feature wherein air sucked in due to the fan 110 flows through the air passages 108, 108 from one end to the other, and consequently, lubricating oil within the casing 76 is cooled. Thus, in addition to the cooling effect of the lubricating oil caused by being in contact with the outer wall of the discharge elbow 30 as illustrated in FIG. 1, if cooling is also carried out by means of fan 110 as explained above, effective cooling of the lubricating oil can be achieved.

In all the embodiments above, gear trains of reduction gearbox 50, 96 are formed by use of straight gears 54, 60, bevel gear 68 and pinion gear 70. However, not limited to this, different types of gear trains may be used. Further, regarding the input shaft 52 of reduction of reduction gearbox 50, 96, not limited to coming out opposite to direction of discharge as explained in the embodiments above, but even parallel or at a particular fixed angle to the direction of discharge is also possible;however, its axis of rotation is preferably to be in the horizontal plane. Furthermore, the air space formed between the outer wall of the discharge elbow 30 and separate wall 36 is mainly provided to facilitate the discharge of working fluid to the surroundings in case It leaks out through the hole 32 in the discharge elbow 30, and thereby prevent the penetration of this fluid into the casing 76 of the reduction gearbox 50, 96. However, the shape of the above air space as indicated in the earlier embodiments is not a limiting factor provided it serves the purpose mentioned above. In addition, the shape of the window 42 provided on either side of air space 40 and connecting it to the surroundings is also limited as per the above embodiments.

Industrial Applicability

As previously described, in accordance with the vertical axis pump of the present invention, since the reduction gearbox is mounted onto the outer wall of the discharge elbow, the installation height of the vertical axis pump is reduced. As a result, the assembly work becomes more convenient. Moreover, as the driver connected to the reduction gearbox is installed onto the same floor level as the discharge elbow, hence the conventional two-floor construction of a pump room becomes unnecessary, which in itself reduces the construction cost of the pump room considerably.

What is claimed is:

1. A vertical axis pump wherein:

said vertical axis pump is arranged in such a manner that a pump shaft comes out of a outer wall of a discharge elbow, a reduction gearbox is mounted onto said discharge elbow and said pump shaft coming out of the outer wall of said discharge elbow is then coupled to said reduction gearbox.

2. A vertical axis pump as claimed in claim 1 wherein:

said vertical axis pump is arranged in such a manner that said reduction gearbox is mounted onto the outer wall of said discharge elbow in a one-Piece construction.

3. A vertical axis pump as claimed in claim 1 wherein:

said vertical axis pump is arranged in such a manner that an input shaft of said reduction gearbox comes out in the horizontal direction and is connected to a driver, and this driver and said discharge elbow are installed onto the same floor level.

4. A vertical axis pump as claimed in claim 1 wherein:

said vertical axis pump is arranged in such a manner that said pump shaft passes through a separate wall provided above the outer wall of said discharge elbow, forming a casing for said reduction gear box by including said separate wall, an air space being thereby formed between said separate wall and the outer wall of said discharge elbow, and said air space is open through and through to the atmosphere.

5. A vertical axis pump as claimed in claim 1 wherein:

said vertical axis pump is arranged in such a manner that a casing of said reduction gear box is formed on including the outer wall of said discharge elbow, such that lubricating oil of said reduction gear box flow down along the outer wall of said discharge elbow and collect within the casing.

6. A vertical axis pump as claimed in claim 1 wherein:

said vertical axis pump is arranged in such a manner that air passage passing through a casing and having both ends open to the atmosphere is provided, and a fan being fixed or coupled to a input shaft of said reduction gearbox such that air draft created by said fan flows from one end of said passage to its other end.

7. A vertical axis pump as claimed in claim 1 wherein:

said vertical axis pump is arranged in such a manner that said pump shaft comes out through the outer wall of said discharge elbow, and a output stage gear of a gear train of said reduction gearbox is mounted onto it.

8. A vertical axis pump as claimed in claim 1 wherein:

said vertical axis pump is arranged in such a manner that a output stage gear of a gear train of said reduction gearbox is mounted onto a hollow shaft, and this hollow shaft is inserted into said pump shaft coming out of the outer wall of said discharge elbow.

9. A vertical axis pump as claimed in claim 8 wherein:

said vertical axis pump is arranged in such a manner that said pump shaft penetrates out through a separate wall provided above the outer wall of said discharge elbow, and a casing of said reduction gear box being formed including this separate wall, and also forming a clearance gap co-axial with said pump shaft between the lower end of said hollow shaft and said pump shaft, and fixing this lower end part to said separate wall by free insertion of a hollow body co-axial to said pump shaft into this clearance gap.

* * * * *